United States Patent [19]

Garvey

[11] Patent Number: 4,488,697

[45] Date of Patent: Dec. 18, 1984

[54] BAG HOLDER

[76] Inventor: Norman G. Garvey, 730 Randolph St., Harahan, La. 70123

[21] Appl. No.: 442,025

[22] Filed: Nov. 16, 1982

[51] Int. Cl.[3] ..... B65B 67/04

[52] U.S. Cl. ..... 248/101; 248/97

[58] Field of Search ..... 248/95, 97, 99, 100, 248/101; 220/404

[56] References Cited

U.S. PATENT DOCUMENTS

| | | | |
|---|---|---|---|
| 56,402 | 7/1866 | Gillett . | |
| 1,414,575 | 5/1922 | McCart | 248/101 X |
| 2,145,613 | 1/1939 | Shenk et al. . | |
| 2,688,429 | 9/1954 | Davison | 248/101 X |
| 3,253,812 | 5/1966 | Okazaki . | |
| 3,298,647 | 1/1967 | Shepard . | |
| 3,487,989 | 1/1970 | Rausing et al. | 220/404 X |
| 4,133,356 | 1/1979 | Dillingham . | |

FOREIGN PATENT DOCUMENTS

| | | | |
|---|---|---|---|
| 400007 | 4/1966 | Switzerland | 248/97 |
| 386366 | 1/1933 | United Kingdom | 248/97 |
| 562739 | 7/1944 | United Kingdom | 248/99 |

*Primary Examiner*—J. Franklin Foss

*Attorney, Agent, or Firm*—Banner, Birch, McKie & Beckett

[57] ABSTRACT

A bag holder for supporting and holding open a bag. The bag holder includes an annular outer frame having a central opening and a surrounding lip adapted to receive and retain the open end of a bag. A retaining ring fits inside the central opening of the frame and has an outwardly directed flange with a lower shoulder adapted to overlie the lip on the frame. Positioned on the retaining ring below the shoulder is a gasket. When the retaining ring is inserted into the frame, the gasket bears against a bag on the lip of the frame. The bag is retained by the wedging action of the gasket between the lip and the shoulder. Three angled legs support the frame.

12 Claims, 4 Drawing Figures

BAG HOLDER

BACKGROUND OF THE INVENTION

1. Technical Field

This invention relates to a frame for supporting and holding open a bag. More particularly, the invention concerns a support for maintaining a bag in an open position wherein the weight of the contents of the bag causes the bag to be more firmly secured in the support.

2. Background Art

Bag holders for supporting a bag in which the mouth of the bag is held open so that it can readily receive refuse or other material to be inserted in the bag are well-known in the art, as disclosed, for example, in Okazaki, U.S. Pat. No. 3,253,812; Dillingham, U.S. Pat. No. 4,133,356; Shepard, U.S. Pat. No. 3,298,647; Shenk, U.S. Pat. No. 2,145,613; Gillett, U.S. Pat. No. 56,402; Cornell, U.S. Pat. No. 3,893,649; and Alexander, U.S. Pat. No. 3,412,965. As is obvious from the many prior art patents relating to bag holders, and as illustrated by the various different solutions exemplified in the cited patents and other prior art, the problem of supporting a bag in an open position has been long-standing, and its solution has been subject to many different approaches, many of them complex and costly. The invention described and claimed herein solves the problem of keeping the mouth of the bag open and securely attached to the support as the weight of the material in the bag is increased in a simple, yet effective, manner.

SUMMARY OF THE INVENTION

The bag holder of the present invention includes an annular outer frame having an a central opening sized to receive and retain the open end of a bag. The frame has an upper lip surrounding the central opening over which the end of the bag is folded. An annular retaining ring sized to fit within the central opening of the frame has an outwardly directed, downwardly facing shoulder adapted to overlie the lip on the frame. An annular resilient gasket surrounds the retaining ring beneath the shoulder. When the retaining ring is inserted into the frame opening, the gasket contacts the bag resting on the lip. As material is inserted into the bag and the weight in the bag is increased, the downward force exerted on the bag causes a wedging action of the gasket as it tends to be drawn against the converging mating surfaces of the frame and the retaining ring. This wedging action of the gasket serves to firmly retain the bag in the holder.

DESCRIPTION OF THE PREFERRED EMBODIMENT

Figure 1:
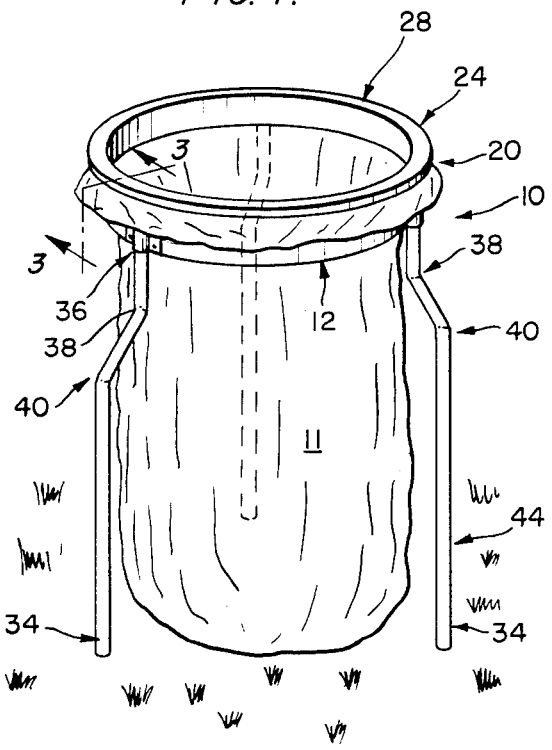
FIG. 1 is a perspective view of a bag holder according to the invention in its fully assembled condition, with a bag inserted into the holder.
Figure 2:
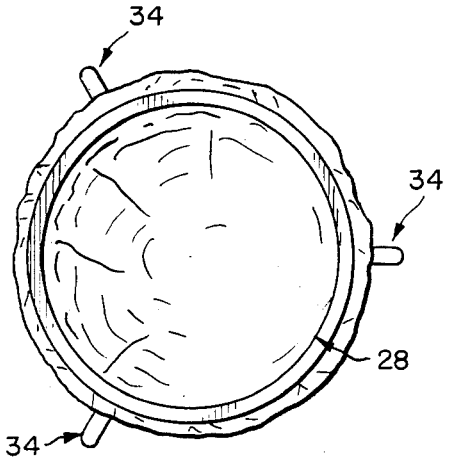
FIG. 2 is a top plan view of a bag holder according to the invention.

A bag holder is indicated generally at 10. A bag inserted in the bag holder 10 is illustrated generally at 11. The holder 10 includes an outer frame 12 having an upright side wall 14 and an outwardly flared flange 16 projecting from the upper edge of the outer frame's wall 14. The upper surface of flange 16 defines a lip 18 for receiving and retaining a bag. The open end of a bag is draped over the flange 16 and extends beyond the flange, as generally shown at 20.

The bag holder also includes a retaining ring 24. Retaining ring 24 has an upright side wall 26 and an outwardly flared flange 28 projecting from the upper edge of side wall 26. The lower surface 30 of flange 28 defines a shoulder against which an annular gasket 32 is retained.

Legs 34 provide support for the bag holder. These legs fit into sockets 36 positioned around the outer periphery of the side wall 14 of frame 12. Legs 34 are selected to be of sufficient height so that when the bag 11 is fully extended, the bottom of the bag will rest on the ground or other support on which legs 34 are placed. Legs 34 are formed with two off-set intermediate bends 38 and 40. These off-set bends define an upper portion 42 of the leg 34 which is closely adjacent to the outer dimensions of the bag 11 when the bag is inserted in the bag holder. This portion of the leg helps to support the side walls of the bag. The lower portion 44 of the leg 34 is off-set by means of bends 38 and 40 to define a base diameter larger than the diameter of upper portion 42. The bottoms of the legs are thus outwardly displaced from the tops of the legs, which provides stability for the bag holder and clearance for a bulging bag.

Figure 3:
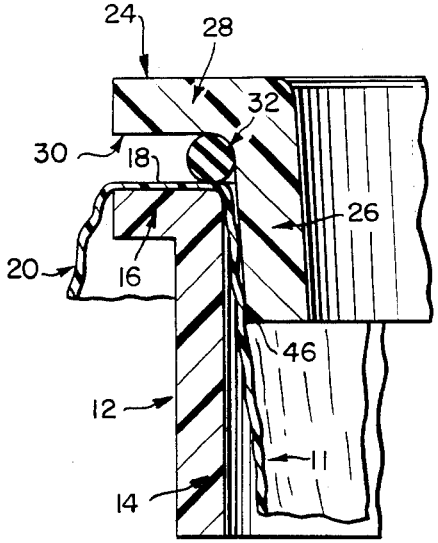
FIG. 3 is a sectional view of a portion of the bag holder of the invention, taken along line 3—3 of FIG. 1.
Figure 4:
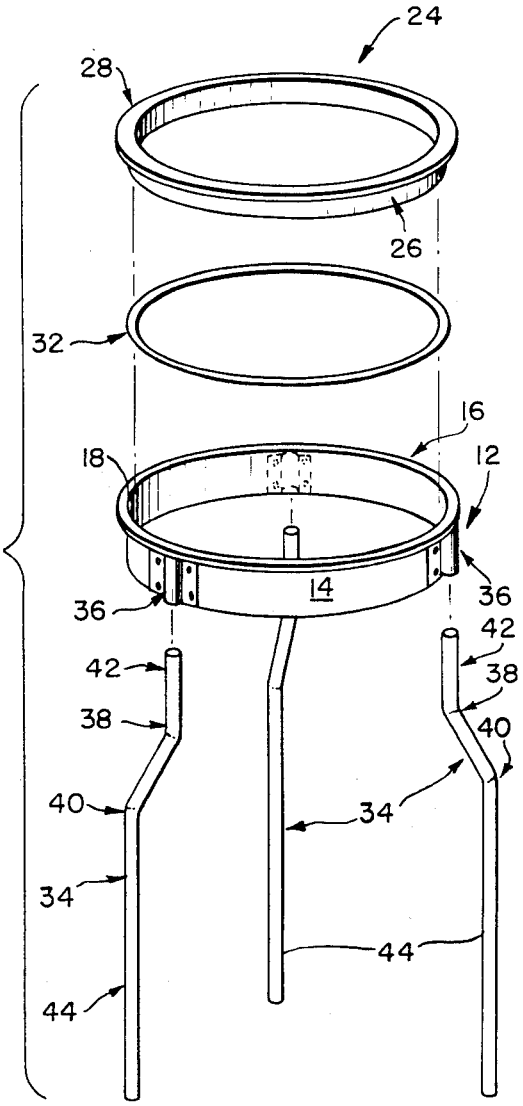
FIG. 4 is an exploded view of a bag holder according to the invention.

In use, the legs 34 are inserted in sockets 36 and thus define a support for the frame 12. The bag holder, thus assembled, is placed on the ground or other support. Bag 11 is inserted through the central opening in frame 12. The open end of the bag is draped over the lip 18 of the outwardly extending flange 16. Retaining ring 24 is inserted into frame 12. The outer diameter of side wall 26 of retaining ring 24 is less than the inner diameter of side wall 14 of frame 12. Thus, side wall 26 fits within side wall 14 as illustrated at FIG. 3 to define a narrow passageway 46 through which bag 11 may pass.

In order to retain the bag in the open position and secured within the bag holder, retaining ring 24 is inserted into frame 12 until gasket 32 comes to rest against the open end of the bag which is draped over the lip 18 of outwardly extending flange 16. As material is placed into the bag and the weight in the bag is increased, a downward force is exerted on the bag which tends to pull the draped portion through the passageway 46. Initial small movement of the draped portion 20 causes gasket 32 to be wedged against the shoulder 30 of outwardly flared flange 28, the outer surface of side wall 26 and the outer edge 20 of bag 11 resting on lip 18 and thus gasket 32 serves to firmly retain the bag in the bag holder.

The gasket 32 also serves to vertically space flange 28 from flange 16 so that the retaining ring 24 can be easily removed from frame 12 by grasping the bottom surface 30 of retaining ring 24. This facilitates easy removal of the bag from the bag holder.

The bag holder disclosed herein may be made of any suitable material. In the preferred embodiment, the bag holder is made from a polyurethane plastic, while gasket 32 is made of a rubber material.

While the bag holder has been described with respect to a preferred embodiment, it is to be understood that numerous modifications may be made to the present invention without parting from its scope, which is defined in the following claims.

I claim:

1. In a bag holder for supporting an open-ended bag, the holder having an annular outer frame with a central opening sized to receive the open end of a bag passed upwardly therethrough and an upper lip surrounding the opening over which the end of the bag is folded, and an annular retaining ring sized to fit within the open end of the bag and the central opening of the frame and clamp the bag to the frame, the improvement comprising:

an outwardly extending, downwardly facing shoulder on said retaining ring adapted to overlie said lip; and an annular resilient gasket surrounding said retaining ring beneath said shoulder adapted to bear against the bag resting on said lip to wedgingly and frictionally prevent downward movement of the bag between said frame and said retaining ring and facilitate easy separation of said retaining ring and said frame.

2. A bag holder according to claim 1 wherein said shoulder is the lower surface of an outwardly directed flange on said retaining ring.

3. A bag holder according to claim 2 wherein said gasket is retained on said retaining ring.

4. A bag holder according to claim 1 further comprising three legs attached to and supporting said frame, a major portion of the length of each of said legs being disposed outwardly of said central opening of said frame to provide clearance between said legs for a bulging bag.

5. A bag holder according to claim 4 wherein each of said legs comprises a substantially upright upper portion attached to said frame, a substantially upright lower portion outwardly offset from said upper portion; and a downwardly and outwardly directed intermediate portion interconnecting said upper and lower portions.

6. A bag holder according to claim 5 further comprising three upright sockets on said frame for retaining the upper portions of said legs.

7. A bag holder for supporting an open-ended bag in an upright position comprising:

an annular outer frame with a central opening sized to receive the open end of a bag passed upwardly therethrough, and an upper lip surrounding the opening over which the end of the bag is folded;

leg means connected to said frame for supporting the frame above the ground;

an annular retaining ring having a depending annular side wall sized to fit within the central opening of the frame and define a gap with said frame through which the bag can freely pass, and a downwardly facing shoulder extending outwardly from said annular side wall and adapted to overlie said lip; and an annular resilient gasket surrounding said annular side wall beneath said shoulder adapted to bear against the bag resting on said lip to wedgingly and frictionally prevent downward movement of the bag between said frame and said retaining ring and facilitate easy separation of said retaining ring and said frame.

8. A bag holder according to claim 7 wherein said shoulder is the lower surface of an outwardly directed flange on said retaining ring.

9. A bag holder according to claim 8 wherein said gasket is retained on said retaining ring.

10. A bag holder according to claim 7 wherein said leg means comprises three legs attached to and supporting said frame, a major portion of the length of each of said legs being disposed outwardly of said frame to provide clearance between said legs for a bulging bag.

11. A bag holder according to claim 10 wherein each of said legs comprises a substantially upright upper portion attached to said frame, a substantially upright lower portion outwardly offset said upper portion, and a downwardly and outwardly directed intermediate portion interconnecting said upper and lower portions.

12. A bag holder according to claim 11 further comprising three upright sockets on said frame for retaining the upper portions of said legs.

* * * * *